United States Patent [19]

Schlegel

[11] Patent Number: 4,748,306

[45] Date of Patent: May 31, 1988

[54] CONTROL BUTTON UNIT HAVING BLOCK ELEMENTS WITH COUPLED MOVABLE MEMBERS

[75] Inventor: Eberhard Schlegel, Duermentingen, Fed. Rep. of Germany

[73] Assignee: Firma Georg Schlegel, Duermentingen, Fed. Rep. of Germany

[21] Appl. No.: 918,045

[22] Filed: Oct. 14, 1986

[30] Foreign Application Priority Data

Nov. 5, 1985 [DE] Fed. Rep. of Germany ..... 3539178

[51] Int. Cl.[4] ..... H01H 9/02

[52] U.S. Cl. ..... 200/307; 200/303; 200/50 C; 200/5 EA; 200/159 R; 200/314

[58] Field of Search ..... 200/307, 303, 340, 5 B, 200/5 E, 5 EA, 50 C, 159 R, 328, 153 J, 314, 153 T

[56] References Cited

U.S. PATENT DOCUMENTS

| | | | |
|---|---|---|---|
| 3,142,732 | 7/1964 | Clarke et al. | 200/50 C |
| 3,514,554 | 5/1970 | Boysen | 200/307 X |
| 3,676,630 | 7/1972 | Dennison | 200/307 X |
| 4,029,924 | 6/1977 | Frank et al. | 200/307 |
| 4,064,381 | 12/1977 | Mullen et al. | 200/307 X |
| 4,242,544 | 12/1980 | Schweitzer | 200/5 E |
| 4,282,414 | 8/1981 | Johnston et al. | 200/307 X |
| 4,315,123 | 2/1982 | Fujita et al. | 200/307 |
| 4,367,383 | 1/1983 | Jommanson | 200/153 J |

FOREIGN PATENT DOCUMENTS

| | | | |
|---|---|---|---|
| 642914 | 5/1964 | Belgium | 200/307 |
| 1125824 | 6/1982 | Canada | 200/307 |
| 1169549 | 11/1964 | Fed. Rep. of Germany | 200/153 J |
| 2825686 | 5/1979 | Fed. Rep. of Germany | 200/307 |
| 298966 | 10/1971 | U.S.S.R. | 200/153 J |

OTHER PUBLICATIONS

Rafi-Click Befehlsgerate Brochure pp. 1 and 4.
Klockner-Moeller Brochure, '85, pp. 1, 2, 3, 14, 15.
Sammel Katalog 2, 1985, pp. 1 and 6.

*Primary Examiner*—Henry J. Recla
*Assistant Examiner*—Ernest G. Cusick
*Attorney, Agent, or Firm*—Spencer & Frank

[57] ABSTRACT

A control button unit with a block element design includes an actuator (1) having a manually operable plunger (6), which is preferably cylindrical and hollow for the purpose of interior illumination, and a coupling piece (9) having several plug-in locations for receiving electrical block elements (10 and 12) parallel and next to one another. The block elements may include a pair of switching elements (10, 12) with differing contact arrangements and a lighting element (11) to illuminate the interior of the plunger. The block elements have movable members (15, 19) contained therein so that they can be coupled to one another and moved in unison when the plunger is actuated. To provide such coupling the movable members (15, 19) have recesses and/or projections which cooperate to interlock the movable member of different block elements. One of the block elements, particularly the lighting element (11), may include a mechanism (16) for the high and low locking of the respective movable member (15), so that each switching element (10, 12) can be coupled selectively to it for operation either by touch engagement to provide a momentary switch or by locking engagement to provide a push-on, push-off switch.

17 Claims, 3 Drawing Sheets

CONTROL BUTTON UNIT HAVING BLOCK ELEMENTS WITH COUPLED MOVABLE MEMBERS

BACKGROUND OF THE INVENTION

The invention relates to a control button unit with a block element design, and more particularly to a control button unit of the type which includes a housing mountable in a supporting wall and a hollow plunger which can be returned by means of a spring, the outer end of the plunger being designed as a pushbutton that is illuminable from inside. A coupling piece having several plug locations receives block elements that are arranged in parallel and next to one another. Among other things, a block element may be designed as a switching element with a movable member which is mounted so as to be displaceable in the direction of movement of the plunger and which is actuable by the plunger, the switching element having at least one set of contacts. A block element may also be designed as a lighting element with a lampholder or other light source.

A known control button unit of this type is sold under the trademark RAFIX S 22 by Messrs. Rafi GmbH & Co. The actuator of this control button unit has a round pushbutton, and the coupling piece has three plug locations. The switching elements are designated as contact elements. Their movable members have a flat end projecting at the top and each carries a contact bridge which acts as a break contact or a make contact, depending on the type of switching element in question. The connecting terminals are located on the underside facing away from the observer. The lighting element, which can only be attached at the middle plug location of the coupling piece, merely contains the connecting terminals for the lampholder placed on top.

Because of the hollow round form of the plunger which is necessary for receiving the lamp and lampholder to illuminate the pushbutton, the plunger only reaches the movable members of the switching elements when these are inserted in the outer plug locations. It is possible to do without the lighting element and a third switching element can be inserted in the middle plug location instead of the lighting element, but a special thrust piece then has to be inserted into the plunger. The special thrust piece is needed in order to fill the end face of the plunger in the center so that the movable member of the middle switching element can also be reached and moved by the plunger.

Control button units of this type may be used for the manual control of motor drives with opposite directions of rotation, for example to open and close a gate. As is customary, for each direction of rotation there is a control button unit which is equipped with a "break" switching element and a "make" switching element. In such cases, the break contact in the "right-rotating" control button unit breaks the circuit for rotation to the left, and vice versa (electrical locking). A problem may arise since the working contact bridge may become welded to its counter-contact pieces and jam when the pushbutton is released. However, the break contact contained in the other switching element returns to its position of rest and therefore no longer performs its locking function. The known control button unit is thus unsuitable for switching arrangements in which specific interdependences between the individual switching elements have to be taken into account.

There is often a need, in the control button units described and in similar ones, to actuate the switching elements not by touch engagement, but by locking engagement, so that the contact sets are brought into one position by pressing on the pushbutton and, after the pushbutton has been released, are brought into the other position by exerting pressure again. It is known from German Patent Specification No. 1,169,549 and, without actual proof, also from control button units with a block element design, to accommodate the mechanism for the so-called high and low locking in the actuator. The result of this is that an actuator without this mechanism and one with this mechanism have to be kept in stock. A further disadvantage of this known construction is that, if it becomes necessary at a later stage to change the switching function from locking engagement to touch engagement, or vice versa, the actuator built into the supporting plate has to be exchanged, and this is extremely troublesome. Also, all the contact sets can only be actuated either by touch engagement or by locking engagement (no mixture).

SUMMARY OF THE INVENTION

The object on which the invention is based is to provide a control button unit of the type described in the introduction, the actuator of which requires no special thrust piece or other accessory part, when a switching element instead of a lighting element is inserted in the middle plug location. Furthermore, it will also be possible to use the control button unit in circuits with electrical locking.

According to the invention, this object is achieved when the movable members of the disk-shaped elements can be coupled to one another. This can be obtained by means of an insertable cross-connection or, in particular, by providing recesses and/or projections in the side faces of the movable members, with the projections extending perpendicular relative to the sides of the block elements and into the recesses.

As a result of a lateral coupling of this type, the movable member of a switching element which is located at the middle plug location, along the plunger axis, can be moved by the movable member of at least one switching element attached next to it. However, a lighting element can also have a loosely movable member which merely serves to couple together adjacent switching elements on both sides, for example when these function as break and make contacts within an electrical locking circuit. It is also possible to provide more than three plug locations on the coupling piece, and the switching elements inserted further to the outside are likewise operated via appropriate couplings. The number of elements which can be arranged next to one another is therefore not limited, and there is no need for an accessory part to change the end face of the actuator plunger.

In a particularly expedient embodiment of the coupling arrangement, a projection and a recess are provided on one side face of a moable member at the same height and, at the same distance from the transverse mid-plane and on the other side face, in line with the projection, a further recess. This ensures that two block elements can be coupled to one another such that the projections face one another and so that the projection of one element engages into the further recess of the other element. Thus, when a set of several block elements is assembled, it is possible to ensure that no porjection protrudes at the ends.

The invention makes it possible to achieve an essential development in a control button unit of the particular generic type, according to which there is a special block element which has a movable member and a mechanism for the high and low locking of the latter. This element can be attached at any plug location of the coupling piece, thus ensuring that all the switching elements coupled to it perform the locking function. Consequently, in an advantageous way, it is no longer necessary to exchange the actuator for an actuator with high and low locking, but it is sufficient to attach the locking element at a vacant plug location or replace one of the previous elements by the locking element.

Since the known lighting elements do not utilize the available space very efficiently, the element with high and low locking of its movable member can advantageously also be designed as a lighting element, so that a lampholder is arranged above the movable member. The locking mechanism is thus transferred from the actuator to the lighting element. There is a substantial improvement in the utilization of space as a result.

Altogether, the invention provides an extremely flexible and versatile control button unit system which makes assembly easier and reduces the quantities to be kept in stock because it has only a few individual parts.

DESCRIPTION OF THE PREFERRED EMBODIMENTS

Figure 1:
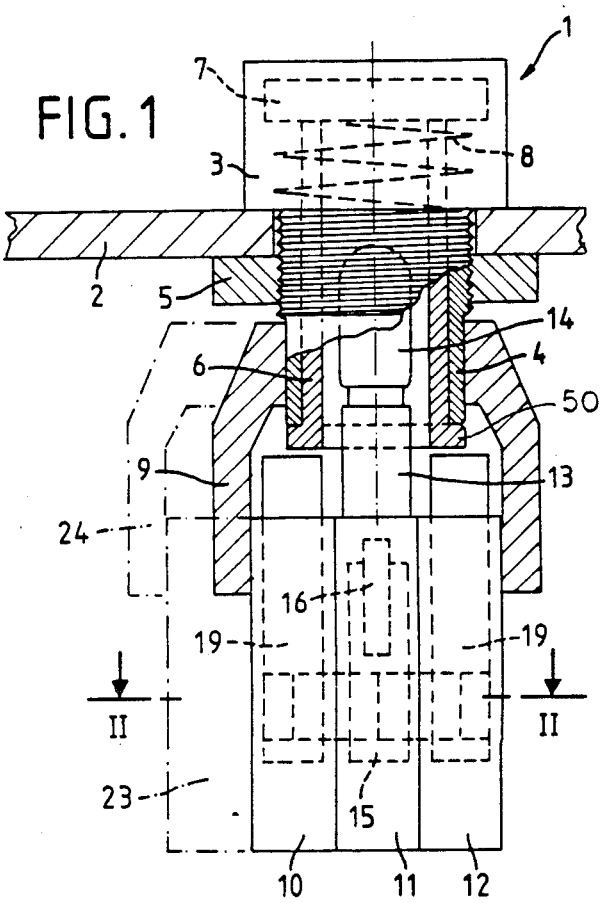
FIG. 1 shows, in a diagrammatic representation, a side view of a control button unit with a block element design, partially cut away, equipped with a lighting and locking element and two switching elements.
Figure 3:
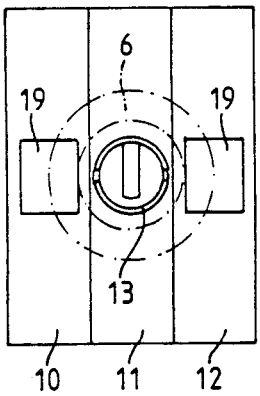
FIG. 3 shows a plan view of the block elements according to FIG. 1.
Figure 2:
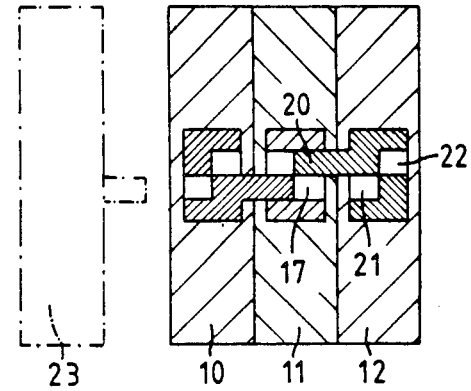
FIG. 2 shows a cross-section through the assembled block elements according to FIG. 1 along the line II—II.
Figure 5:
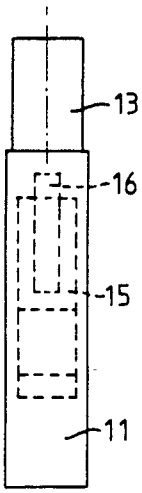
FIG. 5 shows a side view of a lighting and locking element.
Figure 6:
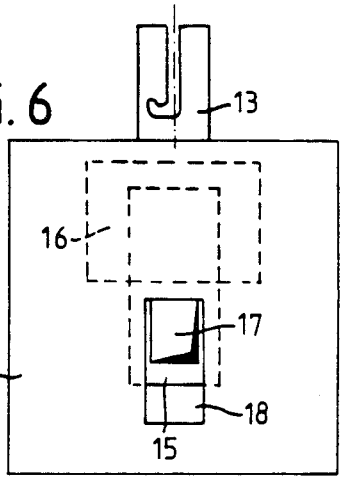
FIG. 6 shows a front view of the lighting and locking element of FIG. 5.

The control button unit according to FIGS. 1 to 3 is fastened by means of its actuator 1 to a supporting wall 2, for example a switchboard or an appliance housing. The actuator housing is divided into a widened head 3 and a cylindrical connector 4, the latter being inserted through the supporting wall 2 and fastened by means of a screw ring 5. A hollow cylindrical plunger 6 is guided displaceably in the connector 4. The plunger end face (see also FIG. 3) is widened in the manner of a flange 50. At the outer end, the plunger 6 is designed as a pushbutton 7. It is held elastically in the position shown by means of a spring 8.

A further component of the control button unit is a coupling piece 9, likewise only shown diagrammatically, which is fastened to the connector 4 in a suitable way and which is designed so that one to three block elements, such as switching elements 10 and 12 and a lighting and locking element 11, can be secured selectively to it in a parallel arrangement, preferably by means of releasable plug connections. The coupling piece 9 shown in FIG. 1 has three receiving locations for mounting the block elements 10–12. The arrangement is such that the middle block element (in FIGS. 1 through 3, the lighting and locking element 11, occupies the middle plug or receiving location, along the axis of the actuator.

Figure 7:
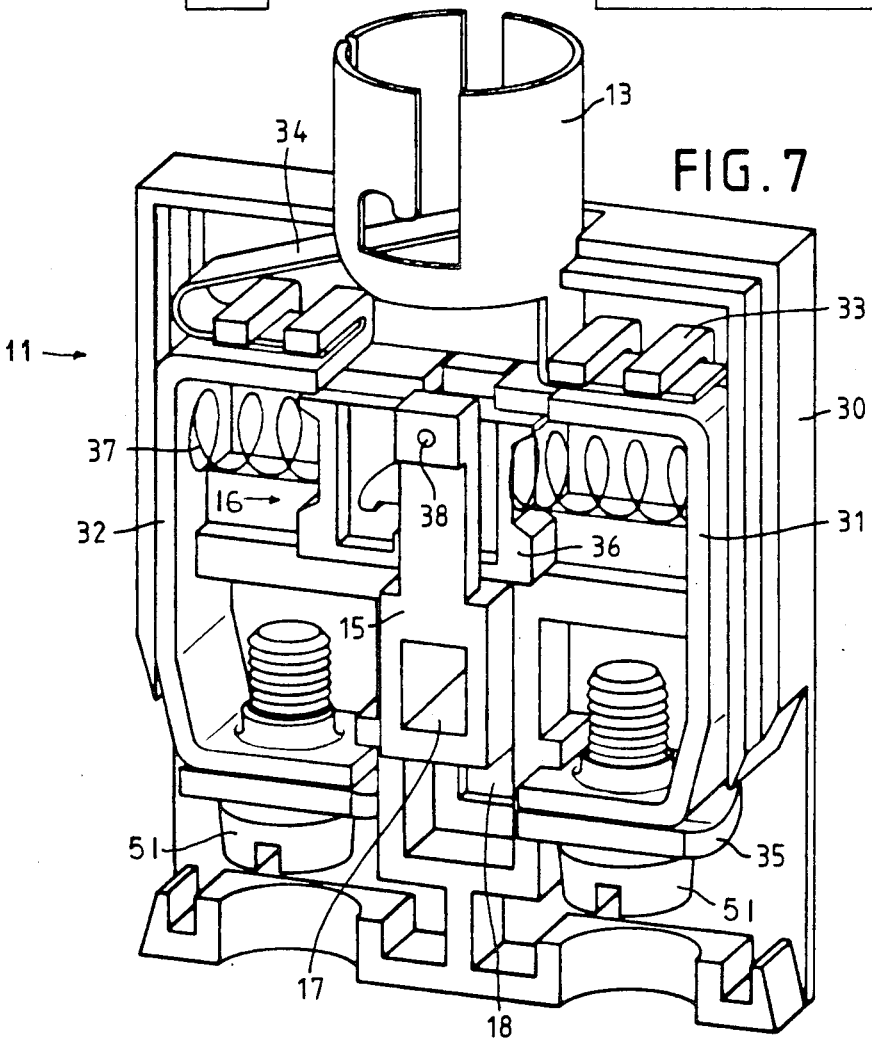
FIG. 7 shows, on a more detailed scale, a perspective representation of a lighting and locking element, in particular with a lampholder and a mechanism for high and low locking, one half of the housing being removed.

The essential individual parts of the lighting and locking element 11, which will also be explained in detail with reference to FIGS. 1 and 7, are: a lampholder 13 resting on top for a filament lamp 14 which projects into the hollow plunger 6 and which illuminates the contact zone of the pushbutton 7, a movable member 15 mounted so as to be displaceable in the direction of movement of the plunger 6, and a locking mechanism 16 interacting with this movable member 15. The movable member 15 has a transversely continuous rectangular receiving orifice 17 which is accessible through rectangular apertures 18 in the two wide sides of the element housing 30 (only part of which is shown in FIG. 7) in each position of the movable member.

Figure 8:
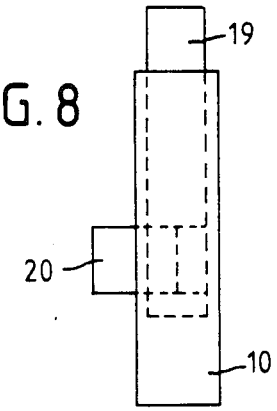
FIG. 8 shows a side view of a switching element, again in a diagrammatic representation.
Figure 9:
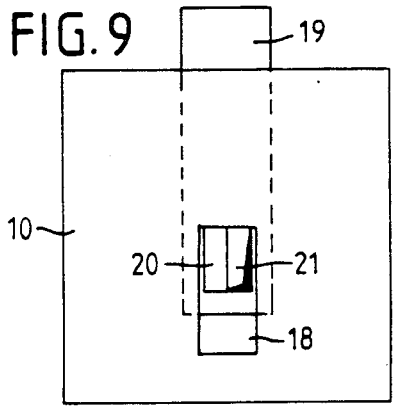
FIG. 9 shows the front view of the switching element of FIG. 8.

As individual parts of the switching element 10 (the configuration of switching element 12 is similar) FIGS. 8 and 9 show a movable member 19. Movable member 19 projects above the element housing and has a square upper end which is pressed down by the flange 50 of the plunger 6 when the pushbutton 7 is actuated. A restoring spring 41 (see FIG. 10) and the contact sets, that is to say one or more break contacts or made contacts depending on the particular embodiment, are not shown in the diagrammatic representation. For coupling switch element 10 to other block elements, the movable member 19 has, on one side, a projection 20 of rectangular cross-section which projects perpendicularly relative to a side surface of switch element 10. Located immediately next to this projection 20 is a receiving orifice 21 of the same size, which can be continuous or, in the example, extends up to the mid-plane of the switching element parallel to the a side surface. On the opposite side, movable member 19 likewise has a receiving orifice 22 which is in line with the projection 20 and which has the same cross-section as the latter. Apertures 18 on both sides of the element housing make it possible, as with the lighting and locking element 11, to gain access to the receiving orifices 21 and 22 and for the projection 20 to pass through. The apertures 18 are extended downwards by the amount of the stroke length, so that the stroke movement of the movable member 19 is not impeded.

The elements 10 to 12 according to FIGS. 1 to 3 are arranged in such a way that the projections 20 of the two switching elements 10 and 12 engage from both sides into the receiving orifice 17 of the movable member 15 of the lighting and locking element 11. As a result, these three movable members are coupled to one another. The movable member 15 follows all the movements of the other two movable members 19. Conversely, however, when the movable member 15 is locked by means of the locking mechanism 16, the movable members 19 are also retained in the lower or upper position. The two switching elements 10 and 12 thus act with a locking effect, that is to say as a switch. When the pushbutton 7 is pressed, they move downwards and are retained there by the locking mechanism 16. After release, the pushbutton 7 and the plunger move back by themselves. When pushbutton 7 is pressed again, the lock is broken and the three movable members return together to the upper, initial position. The three elements 10 to 12 are assembled by first inserting them into one another perpendicularly relative to their broad sides and then introducing the entire assembly into the coupling piece 9 in the direction of movement of the plunger and, for example, latching it.

The function described does not change when a switching element, for example 12, is omitted or further switching elements 23 are added, as represented by dot and dash lines in FIGS. 1 and 2. However, an appropriately widened coupling piece 24 is required for this purpose.

If the locking mechanism 16 and the movable member 15 are omitted in the lighting and locking element 11, a pure lighting element known per se would be obtained. The two switching elements 10 and 12 would then operate by touch engagement, that is to say, after the pushbutton 7 has been released, they would return to the initial position each time.

Figure 11:
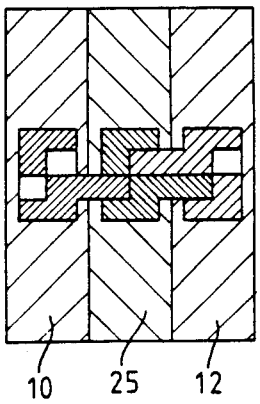
FIG. 11 shows a cross-section through three switching elements coupled to one another.

If it is not necessary to illuminate the pushbutton 7, a further switching element 25 can be inserted in the center instead of the lighting and locking element 11, as shown in FIG. 11. It is coupled on both sides to its adjacent elements, and all three movable members work together by touch engagement .

Figure 4:
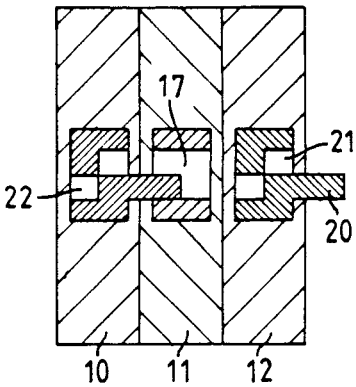
FIG. 4 shows a cross-section through the block elements in another arrangement.

Finally, the assembly arrangement shown in FIG. 4 can also be such that, although the lighting and locking element 11 is attached in the center and one switching element 10 is coupled to this, the other switching element 12 is, however, inserted laterally reversed, so that the projection 20 faces away from the lighting and locking element 11 and projects outwards. In this configuration, the switching element 10 works by locking engagement and the switching element 12 by touch engagement.

For the sake of completeness, the detailed construction of lighting and locking element 11 will be further described below with reference to FIG. 7. The element housing 30 is made of insulating material an consists of two half-shells which fit together, only the rear one of which is shown. It is possible to see the above-mentioned aperture 18 and orifices for introducing connecting wires (not shown) for the lamp and inserting a screwdriver for the clamping screws 51. Two metal clips 31 and 32 are inserted into the housing 30. These clips have clamping fingers 33 at their upper angled ends. The clamping fingers 33 of clip 31 connect the latter to the lampholder 13 (shown as a bayonet socket), and the other clip 32 is connected in the same way to a leaf spring 34 which forms the other terminal for the filament lamp. The lower ends of the metal clips 31 and 32 are provided with a screw thread and a cover plate 35 for the connection of lead wires.

The detailed construction of locking mechanism 16 will now be described. A locking slide 36 is mounted in the element housing 30 so as to be movable to and fro. It is under the influence of two counter-acting compression springs 37. Moreover, the movable member 15 is mounted in the element housing so as to be movable in the direction of movement of the plunger 6 (see FIG. 1) of the control button unit. The movable member 15 surrounds the locking slide 36 in the manner of a fork. Inserted transversely at the end of at least one form prong is a peg 38 which interacts with a groove in the form of a cardioid curve on the locking slide 36. The shape of this cardioid curve is described in principle in German Patent Specification 1,169,549.

As is explained in the patent specification mentioned, this arrangement ensures high and low locking of the movable member 15, and at the same time it must be remembered that the movable member 15, because it is coupled to switching element 10, is under the effect of the restoring spring 41 (see FIG. 10) of the movable member 19 of this switching element.

Figure 10:
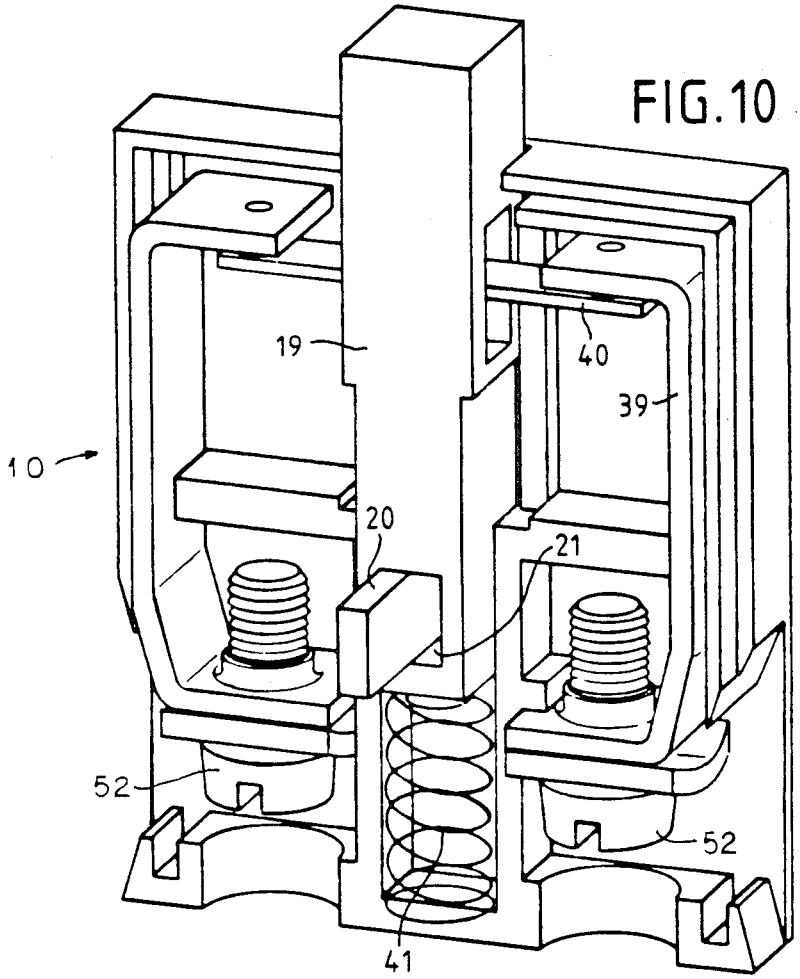
FIG. 10 shows a perspective representation of a corresponding switching element on a more detailed scale and with one half of the housing removed.

The details of a switching element 10 with a normally closed contact (break contact) will now be explained with reference to FIG. 10. As with the lighting and locking element 11 according to FIG. 7, there is a housing made of insulating material, into which two metal clips 39 are inserted in a mirror-inverted arrangement. These have screws 52 at the bottom for connection to wires (not shown), as described, and the upper ends are likewise angled. A precious-metal contact is inserted in the lower face of each of the upper angled portions. These contacts interact with a movable contact bridge 40 which is held by the movable member 19. It passes through the latter in the transverse direction. The movable member 19 is guided in the housing so as to be displaceable in the direction of movement of the plunger 6 (see FIG. 1) and is under the influence of a compression spring 41 which presses it upwards. The projection 20 and the receiving orifice 21 can be seen on the movable member 19.

What I claim is:

1. A control button unit, comprising:

an actuating member which includes a housing for installation in a supporting wall, a plunger mounted on the housing for linear movement along a line, and spring means for urging the plunger in a predetermined direction along the line;

a first block element having a broadside with an opening, the first block element additionally having a movable member with a projection which extends through the opening and perpendicular to the broadside of the first block element;

a second block element having a broadside with an opening, the second block element additionally having a movable member with a recess; and a coupling member connected to the actuating member and having a plurality of receiving locations for selectively receiving block elements in parallel juxtaposition, the receiving locations being disposed so that the broadside of a block element in any receiving location is parallel to the line along which the plunger moves and so that the movable member thereof is displaceable in a direction parallel to the line along which the plunger moves, the first and second block elements being mounted on the coupling member at adjacent receiving locations, with the movable member of one of the first and second block elements projecting to a position for actuation by the plunger, wherein the projection on the movable member of the first block element extends through the opening in the broadside of the second block element and into the recess in the movable member of the second block element to couple the movable members of the first and second block elements together.

2. A control button unit as claimed in claim 1, wherein the movable member of the first block element has a pair of side faces, wherein the projection extends from one side face which additionally has a recess at the same height, and wherein the other side face has a further recess in line with the projection.

3. A control button unit as claimed in claim 1, wherein one of the block elements further includes a mechanism for the high and low locking of the movable member thereof.

4. A control button unit as claimed in claim 1, wherein one of the block elements further includes a lampholder arranged above the movable member thereof.

5. A control button unit as claimed in claim 1, wherein one of the block elements further includes at least one set of switch contacts which are opened and closed by the movable member thereof.

6. A control button unit as claimed in claim 1, wherein the plunger is hollow and has an end which is configured as an inwardly illuminated pushbutton.

7. A control button unit, comprising:

a first block element having a first movable member which is linearly displaceable along a first line, the first movable member having a recess therein;

a second block element having a second movable member which is linearly displaceable along a second line, the second movable member having a projection;

a housing for installation in a supporting wall;

a manually actuable plunger mounted on the housing for linear movement along a third line; and coupling piece means, attached to the housing, for supporting the block elements beside one another adjacent an end of the plunger, with the projection entering the recess to couple the movable members together and with at least one of the movable members being positioned for engagement by the end of the plunger, the block elements being disposed so that the first and second lines are spaced apart from one another and are parallel to the third line.

8. A control button unit as claimed in claim 7, wherein the first block element further comprises a set of switch contacts which are opened and closed by the first movable member.

9. A control button unit as claimed in claim 8, wherein the plunger comprises a light-permeable hollow cylinder and the second block element further comprises means for emitting light to the interior of the hollow cylinder.

10. A control button unit as claimed in claim 9, wherein the second block element further comprises locking means for alternatively locking the second movable member in raised and lowered positions when the plunger undergoes a sequence of manual actuations.

11. A control button unit as claimed in claim 8, further comprising an additional block element which is supported by the coupling piece means and which is disposed in a row with the first and second block elements, the additional block element having an additional movable member which is linearly displaceable along an additional line that is spaced apart from but parallel to the first and second lines.

12. A control button unit as claimed in claim 11, wherein the additional block element further comprises a set of additional switch contacts which are opened and closed by the additional movable member.

13. A control button unit as claimed in claim 12, wherein the additional movable member further comprises means for engagement with the movable member of an adjacent block element so that the engaged movable members are displaced in unison when the plunger is manually actuated.

14. A control button unit as claimed in claim 13, wherein the coupling piece means has a plurality of plug locations for selectively receiving block elements.

15. A control button unit as claimed in claim 11, further comprising at least one further block element which is supported by the coupling piece means and which is disposed in a row with the first, second, and additional block element, each at least one further block element having a respective further movable member which is linearly displaceable along a respective further line that is spaced apart from but parallel to the first, second, and additional lines.

16. A control button unit as claimed in claim 8, wherein the second block element further includes locking means for alternatively locking the second movable member in raised and lowered positions when the plunger undergoes a sequence of manual actuations.

17. A control button unit as claimed in claim 7, wherein the coupling piece means has a plurality of plug locations for selectively receiving block elements.

* * * * *